United States Patent [19]

Glang et al.

[11] Patent Number: 5,074,711

[45] Date of Patent: Dec. 24, 1991

[54] PROFILED SEAL FOR TUNNEL SEGMENTS

[75] Inventors: Siegfried Glang, Hamburg; Werner Grabe, Winsen, both of Fed. Rep. of Germany

[73] Assignee: Phoenix AG, Hamburg, Fed. Rep. of Germany

[21] Appl. No.: 570,125

[22] Filed: Aug. 17, 1990

[30] Foreign Application Priority Data

Aug. 19, 1989 [DE] Fed. Rep. of Germany ..... 3927474
Sep. 15, 1989 [DE] Fed. Rep. of Germany ..... 3930870

[51] Int. Cl.[5] ..... E21D 11/38

[52] U.S. Cl. ..... 405/152; 52/396; 277/207 R

[58] Field of Search ..... 405/152; 404/64, 65, 404/69, 74; 52/396, 403; 285/230; 277/207 R, 207 A, DIG. 2

[56] References Cited

U.S. PATENT DOCUMENTS

| | | | |
|---|---|---|---|
| 3,829,107 | 8/1974 | Machado et al. | 285/230 X |
| 4,195,850 | 4/1980 | Berger et al. | 405/135 X |
| 4,199,158 | 4/1980 | de Munck | 405/135 X |
| 4,685,825 | 8/1987 | Buckenauer | 52/396 X |

FOREIGN PATENT DOCUMENTS

| | | |
|---|---|---|
| 414137 | 9/1981 | European Pat. Off. . |
| 337177 | 10/1989 | European Pat. Off. . |
| 306581 | 11/1989 | European Pat. Off. . |
| 340659 | 11/1989 | European Pat. Off. . |
| 368174 | 5/1990 | European Pat. Off. . |
| 7432945 | 1/1975 | Fed. Rep. of Germany . |
| 3543808 | 6/1986 | Fed. Rep. of Germany . |
| 4016247 | 11/1990 | Fed. Rep. of Germany . |

OTHER PUBLICATIONS

European Search Report conducted during prosecution of European Patent No. 414137 (in German language only).

*Primary Examiner*—Dennis L. Taylor
*Attorney, Agent, or Firm*—Collard, Roe & Galgano

[57] ABSTRACT

A profiled seal for use in tunnel segments and comprising cut out grooves along the bottom of the seal; channels along the upper part of the seal; lateral faces and spreading feet for the seal; plus a bridge system having an outer bridge and an inner bridge.

15 Claims, 2 Drawing Sheets

PROFILED SEAL FOR TUNNEL SEGMENTS

BACKGROUND OF THE INVENTION

1. Field of the Invention

This invention relates to a profiled seal for use in tunnel segments and comprises cut out grooves along the bottom of the seal; channels along the upper part of the seal; lateral faces and spreading feet for the seal; plus a bridge system having an outer bridge and an inner bridge.

2. The Prior Art

Sealing frames of a concrete, steel, steel/concrete, or cast iron segment usually consist of four assembled strand-shaped profiled seals, or profiled strips, made of elastomeric material; for example, made of rubber or rubberlike plastic, with the corners of the frames preferably being made by an injection molding process. It is particularly important for the tunnel to be of a tubing construction with a specific arrangement of the segments. It is often sufficient for each segment to have one sealing frame. However, it may be necessary under some circumstances for each segment to be provided with a double sealing frame, with the two parallel sealing frames being able to be connected to one another by an additional transverse profiled seal, such as that disclosed in Ep-A 0,337,177. The profiled seals and sealing frames are usually located in a corresponding groove (groove depth d, groove width w) of the tunnel segment. Under the action of compressive force, the gap separation between two tunnel segments is reduced from S (separation in the unloaded condition) to S' (separation in the loaded condition). This compresses the two opposite elastomeric profiles, which results in the gap being sealed.

Profiled seals used in tunnel projects in the past have primarily had mirror symmetry in cross section relative to the perpendicular longitudinal central plane of the profile. It has turned out in this case that profiled strips that have corrugation grooves and channels running in the longitudinal direction (GB-B 2,170,561; GB-B 2,178,114; GB-B 2,182,987; EP-A 0,255,600; and Ep-A 0,306,796) are particularly effective in their sealing function.

Asymmetric profiled seals (DE-U 7,432,945; EP-A 0,306,581; EP-0,368,174) and activatable profiled seals (DE-A 3,543,808; EP-A 0,340,659) have so far achieved less importance.

SUMMARY OF THE INVENTION

It is an object of the present invention that for cast iron tunnel segments having encircling grooves with a very high tolerance for the groove width, to provide a profiled seal that spans these tolerances and guarantees high sealing power even with very large gaps and mismatches.

The above object is accomplished in accordance with the present invention by providing a profiled seal having a longitudinal direction and a longitudinal central plane, having a bottom face and being made of elastomeric material for use in a tunnel segment provided with an encircling tunnel segment groove having groove depth d and groove width w comprising (a) at least two cut out grooves running along said bottom face in the longitudinal direction, the bottom face having a profile width v; (b) at least two channels running in the longitudinal direction in the upper part of the seal; (c) a side neck on each of two sides of the seal, and at least two lateral faces that are positioned diagonally to the longitudinal direction of the seal and framed by the side necks; (d) two spreading feet with each foot located on one of the two sides of the seal with a profile width v that is smaller than the groove width w, each of the feet being angled upwardly at an angle $\alpha$ relative to the profiled seal bottom face before insertion of the profiled seal in the tunnel segment groove, with the spreading feet being curved inwardly toward the longitudinal central plane after insertion of the profiled seal into the groove, with simultaneous enlargement of the angle $\alpha$ as a centering and lip-seal function of the spreading feet; and (e) a bridge system comprising an outer bridge and an inner bridge that run continuously in a straight line from the bottom face to the back of the profile, the system being present in each half-profile relative to the longitudinal central plane, with the outer bridge being tangential to the channels; each channel is located between the outer bridge and the inner bridge on the outside position of each channel and at the edge neck of the outer bridge; the inner bridge being tangential to the inside position of the same channel and to the outside position of the inner groove; the inner bridge angled at an angle $\beta$ relative to the longitudinal central plane to the center of the profiled seal concentration of the reactive force of the profiled seal on very narrowly defined areas.

BRIEF DESCRIPTION OF THE DRAWINGS

Other objects and features of the present invention will become apparent from the following detailed description considered in connection with the accompanying drawing which discloses three embodiments of the present invention. It should be understood, however, that the drawing is designed for the purpose of illustration only and not as a definition of the limits of the invention.

In the drawing wherein similar reference characters denote similar elements throughout the several views.

DETAILED DESCRIPTION OF THE PREFERRED EMBODIMENTS

Figure 1A:
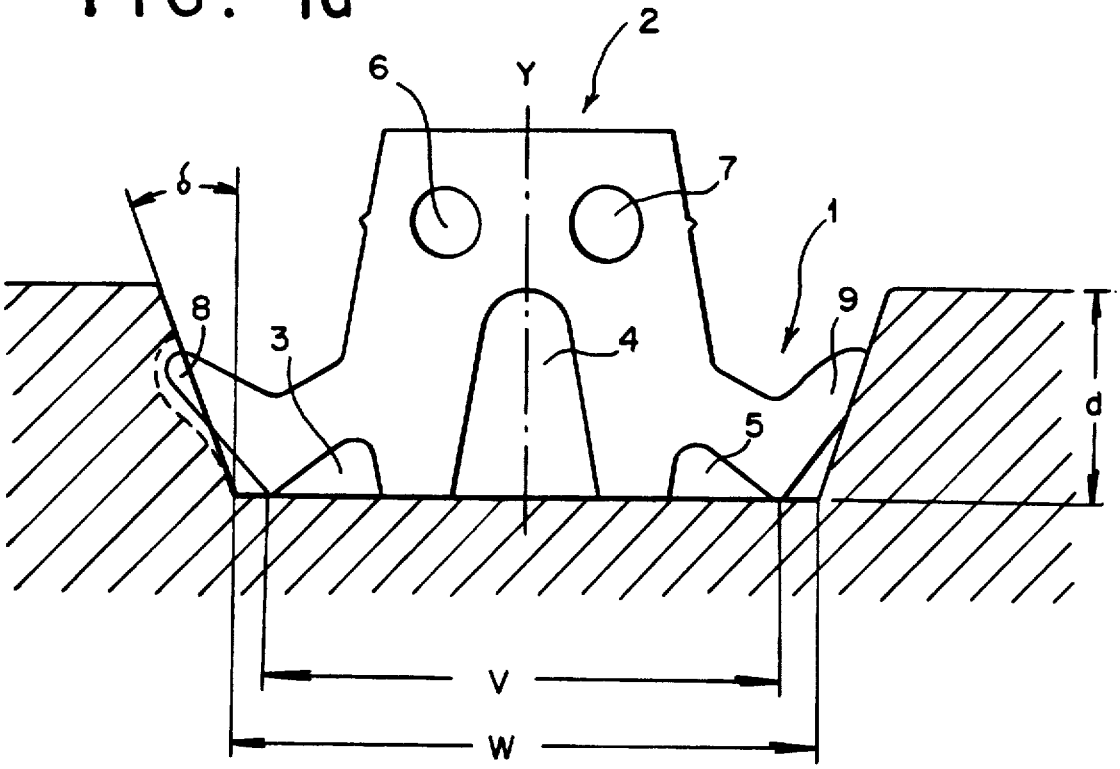
FIG. 1*a* shows a profiled seal having three grooves, two channels and two feet.

Turning now in detail to the drawings, FIG. 1*a* shows how there is located in the tunnel segment groove 1 with the width w and the angle $\delta$, usually ranging from 0° to 30°, and preferably ranging from 10° to 20°, is the profiled seal 2 with the base width v that is smaller than the groove width w. The width w is at least 5 percent smaller than the width w. The profiled seal itself has three cut out grooves 3, 4, and 5, has two channels 6 and 7, and has spreading feet 8 and 9 on the two sides and has the angle $\alpha$ which is relative to the baseline X of the profile shown in FIG. 1*b*. As shown in FIG. 1*a*, the spreading foot 8 illustrates the unloaded condition before insertion into the groove, while the spreading foot 9 represents the loaded condition after insertion into the groove 1. It is preferable for the spreading feet to be curved inwardly toward the longitudinal central plane Y after insertion of the profiled seal into the segment groove, with the simultaneous enlargement of the angle $\alpha$, particularly in the area of the tip of the spreading foot. This change of position of the spreading feet in combination with v being less than w leads to the centering of the profiled seal in the segment groove, with the spreading feet performing the function equivalent to being a lip seal. The height h of the spreading feet (FIG. 1*b*) is smaller than the groove depth d (FIG. 1*a*).

The angle $\alpha$ preferably is from about 50°±5° before insertion of the profiled seal into the segment groove.

Figure 1B:
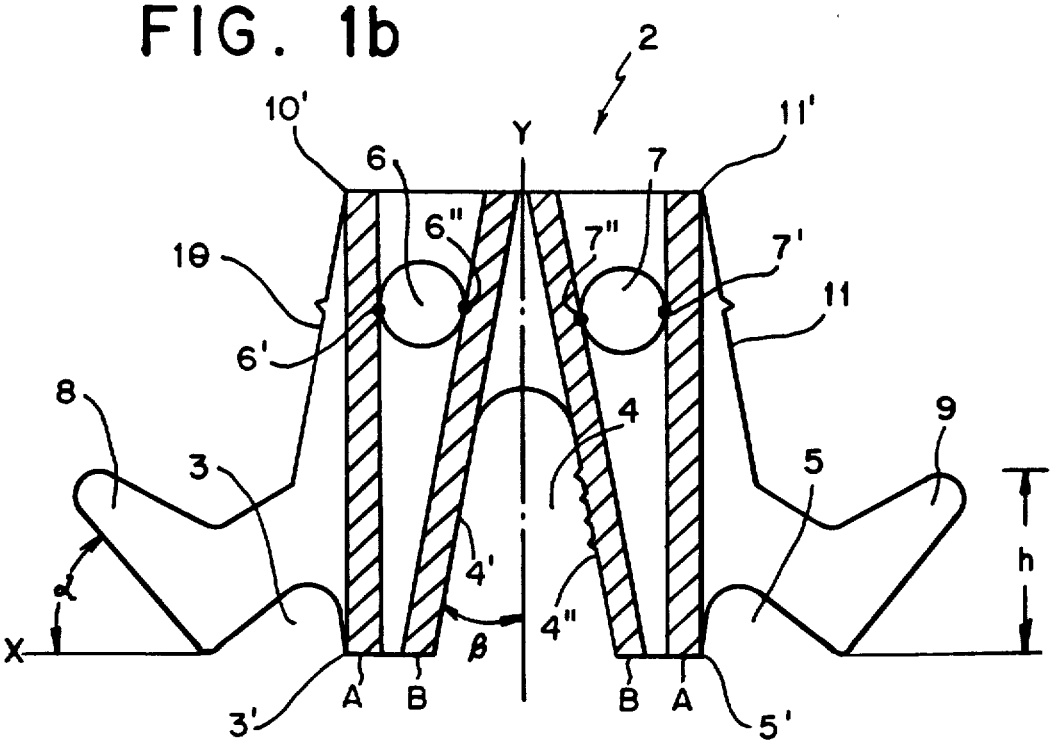
FIG. 1*b* shows the profiled seal of FIG. 1*a* further having an inner and outer bridge system.

FIG. 1*b* shows a schematic illustration of the bridge system A, B found in each half-profile, which is positioned like the spreading feet 8, 9 with mirror symmetry relative to one another and relative to the longitudinal central plane Y. The bridges A, B run from the bottom face to the back of the profile continuously and in a straight line. The perpendicular outer bridges A runs so that they are tangent to the side necks 10', 11', tangent to the channels 6, 7 on the outside positions 6' and 7', and tangent to the outer grooves 3, 5 on the inside positions 3', 5'. The inner bridge B, while being tangent to the inside positions 6'', 7'' of the channels 6, 7 and to the outside positions 4', 4'' of the inner groove 4, runs at an angle $\beta$ relative to the longitudinal central plane Y and relative to the center of the profile. This embodiment causes the reactive force of the profiled seal to be concentrated in very limited regions.

The outer grooves 3, 5 in contrast to the inner groove 4, are of asymmetric shape and also have a smaller depth. The angle of the side or lateral faces 10, 11 corresponds approximately to the angle $\beta$.

The height h of the spreading feet is 50 percent to 80 percent of the groove depth d before insertion into the segment groove. The inner bridge extends at an angle $\beta$ of 10°±3° to the center of the profiled seal.

The ratio of the bridge widths to the diameter of the channels ranges from 1:1 to 1:5 and preferably ranges from 1:2 to 1:4. The outer grooves have a smaller depth than the depth of the inner grooves, with the ratio of depths being from 1:2 to 1:4.

Figure 2:
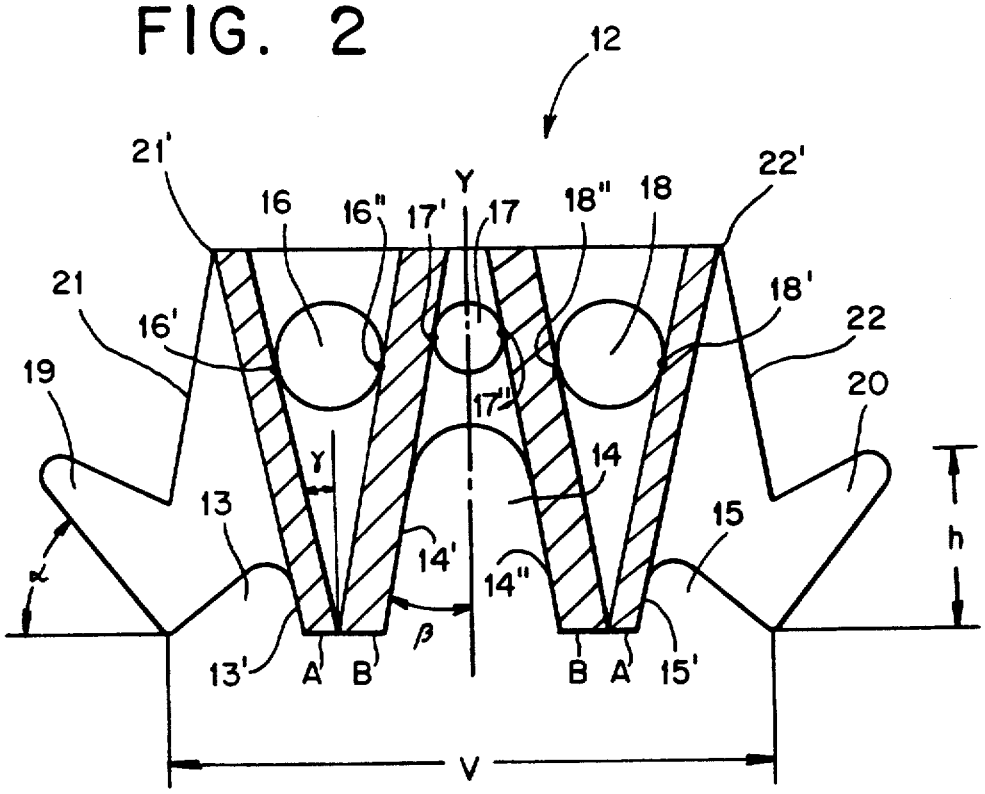
FIG. 2 shows a second embodiment of a profiled seal with three grooves, three channels, inner and outer bridges, and two feet according to the invention.

FIG. 2 shows a profiled seal 12 with three cut out grooves 13, 14, 15, three channels 16, 17, 18, and the spreading feet 19, 20 located on both sides. The outer bridge A with the tangent positions 13', 16', 21'; 15', 18', 22' in this case runs at an angle $\gamma$, that corresponds approximately to the angle $\beta$. The inner bridge B, in addition to the tangent positions 16'', 14'; 18'', 14'', has an additional tangent position 17', 17'', that is brought about by the channel 17 located in the center of the profile.

Figure 3:
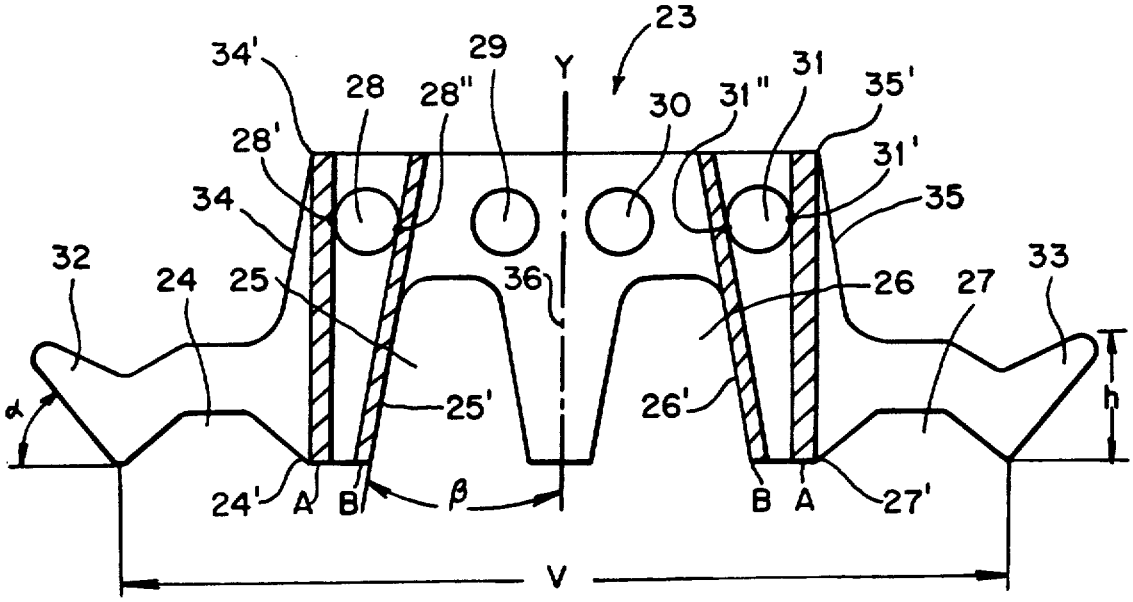
FIG. 3 shows a third embodiment of a profiled seal with four grooves, four channels, inner and outer bridges, and two feet according to the invention.

FIG. 3 shows a profiled seal 23 with four cut out grooves 24, 25, 26, 27, four channels 28, 29, 30, 31, and the spreading feet 32, 33 according to the invention. The perpendicular outer bridge A is fixed by the tangent positions 24', 28', 34'; 27', 31', 35', while the inner bridge B, on the other hand, is fixed by the tangent positions 25', 28''; 26', 31''. There is also an additional continuous bridge 36 in the center of the profile, that runs perpendicular to the bottom face of the profile, like the outer bridge A.

The following Table shows the results of experimental leak tests that were carried out with regard to the profiled seals of FIGS. 1*a*, 1*b*, 2, and 3.

TABLE

| | FIG. 1a, b | FIG. 2 | FIG. 3 |
|---|---|---|---|
| Gap separation $S_0$ [mm] | 11.0 | 7.0 | 12.0 |
| Gap separation $S_1$ [mm] | 3.0 | 3.0 | 5.0 |
| Segment mismatch [mm] | 4.0 | 4.0 | 10.0 |
| Groove depth d [mm] | 7.5 | 7.5 | 6.5 |
| Groove width w [mm] | 20.0 | 20.0 | 37.0 |
| Profile width v [mm] | 17.7 | 17.7 | 34.8 |
| Spreading foot height h [mm] | 5.0 | 5.0 | 5.0 |
| Angle $\alpha$ [degrees] | 50.0 | 50.0 | 50.0 |
| Angle $\beta$ [degrees] | 10.0 | 10.0 | 9.0 |
| Angle $\gamma$ [degrees] | 0 | 10.0 | 0 |
| Angle $\delta$ [degrees] | 19.0 | 19.0 | 19.0 |
| Side angle [degrees] | | | |
| i) | 10.0 | 10.0 | 10.0 |
| ii) | 1:2.5 | 1:3.5 | 1:2.5 |
| iii) | 1:4 | 1:2.7 | 1:4 |
| iv) | 2:7.5 | 1:3 | 2:7.5 |
| Shore A Hardness | 65.0 | 65.0 | 65.0 |
| Sealing strength [bar] | 60.0 | 60.0 | 14.0 |

i) Side faces (10, 11; 21, 22; 34, 35);
ii) Ratio of bridge width (A) to diameter of the channels (6, 7; 16, 18; 28, 31);
iii) Ratio of bridge width (B) to diameter of the channels (6, 7; 16, 18; 28, 31);
iv) Ratio of depths of outer grooves (3, 5; 13, 15; 24, 27) and inner grooves (4; 14; 25; 26); and Cross-impact test (2 bar/15 min, stepwise pressure increase)

COMPARISON EXAMPLE

For comparison, the profiled seal disclosed in GB-B 2,182,987 with a two-row arrangement of channels above the grooves is distinguished by the fact that by itself it shows above-average sealing strength with different groove widths w (particularly in the range of 25 to 36 mm), groove depths (particularly in the range of 10 to 15 mm), and different gap separations $S_o$ (particularly in the range of 13 to 20 mm). Since the method of tunnel construction in Great Britain places a high tolerance capability on the profiled seals, the profile pursuant to GB-B 2,182,987 has meanwhile evolved into the standard profile in Great Britain. Under the criteria specific for tunnels prescribed there (d, w, $S_0$, $S_1$, segment mismatch), leakage values of 4 to 5 bar have been obtained, with 1.5 to 3.5 bar usually being required for tunnel projects in Great Britain. Reference is made to DE-A 4,016,247 for experimental details.

The profiled seals according to the present invention are distinguished from the prior art profiled seal disclosed in GB-B 2,182,987 by substantially higher sealing strength, even with an extremely large segment mismatch of 10 mm (cf. test of the profiled seal of FIG. 3). This development is important because tunnel projects at extreme depths (for example, 100 m in the case of the channel tunnel project between France and Great Britain; leakage requirement: 10 bar) are becoming more and more important.

Although the various embodiments in the above examples involve only profiled seals with open grooves and channels with circular cross sections, the structural principle of the invention is also applicable to profiles with completely or partially closed grooves, such as in GB-A 2,017,194, and to channels with other cross sections, such as oval, for example. Any reduction of sealing strength associated with this can be accepted on the basis of the results shown in the above Table. Although the use of cast iron tunnel segments was a preferred embodiment, the present invention is not limited to this specific type of segment construction.

While only a few embodiments of the present invention have been shown and described, it is to be understood that many changes and modifications may be made thereunto without departing from the spirit and scope of the invention as defined in the appended claims.

What is claimed is:

1. A profiled seal having a longitudinal direction and a longitudinal central plane, having a bottom face and being made of elastomeric material for use in a tunnel segment provided with an encircling tunnel segment groove having groove depth d and groove width w comprising:

(a) at least two cut out grooves running along said bottom face in the longitudinal direction, said bottom face having a profile width v;

(b) at least two channels running in the longitudinal direction in the upper part of the seal;

(c) a side neck on each of two sides of said seal, and at least two lateral faces that are positioned diagonally to the longitudinal direction of the seal and framed by the side necks;

(d) two spreading feet with each foot located on one of the two sides of the seal with a profile width v that is smaller than the groove width w, each of said feet being angled upwardly at an angle $\alpha$ relative to the profiled seal bottom face before insertion of the profiled seal in the tunnel segment groove, with the spreading feet being curved inwardly toward the longitudinal central plane after insertion of the profiled seal into the groove, with simultaneous enlargement of the angle $\alpha$ as a centering and lip-seal function of the spreading feet; and (e) a bridge system comprising an outer bridge and an inner bridge that run continuously in a straight line from the bottom face to the back of the profile, said system being present in each half-profile relative to the longitudinal central plane, with the outer bridge being tangential to the channels;

each said channel located between the outer bridge and the inner bridge on the outside position of each channel and at the edge neck of the outer bridge;

said inner bridge being tangential to the inside position of the same channel and to the outside position of the inner groove;

said inner bridge angled at an angle $\beta$ relative to the longitudinal central plane to the center of the profiled seal concentration of the reactive force of the profiled seal on very narrowly defined areas.

2. A profiled seal according to claim 1, wherein the profile width v is at least 5% smaller than the groove width w.

3. A profiled seal according to claim 1, wherein the spreading feet are positioned with mirror symmetry to one another relative to the longitudinal central plane.

4. A profiled seal according claim 1, wherein the spreading feet are angled upwardly at an angle $\alpha$ of $50° \pm 5°$ before insertion of the profiled seal into the segment groove.

5. A profiled seal according to claim 1, wherein the height h of the spreading feet is 50 percent to 80 percent of the groove depth d before insertion into the segment groove.

6. A profiled seal according to claim 1, wherein the bridge system is positioned with mirror symmetry to one another relative to the longitudinal central plane.

7. A profiled seal according to claim 1, wherein the outer bridge is tangent to the outer groove on the inside position.

8. A profiled seal according to claim 1, wherein the outer bridge is parallel to the longitudinal central plane or is at an angle $\gamma$ which is approximately equal to the angle $\beta$.

9. A profiled seal according to claim 1, wherein the inner bridge extends at an angle $\beta$ of $10° \pm 3°$ to the center of the profiled seal.

10. A profiled seal according to claim 1, further comprising an additional channel placed in the center of the profiled seal and tangent to the inner bridge.

11. A profiled seal according to claim 1, wherein the ratio of the bridge widths to the diameter of the channels ranges from 1:1 to 1:5.

12. A profiled seal according to claim 1, wherein the outer grooves have a cross section different in shape from that of the inner grooves.

13. A profiled seal according to claim 1, wherein the outer grooves have a smaller depth than the depth of the inner grooves, with the ratio of depths being from 1:2 to 1:4.

14. A profiled seal according to claim 1, wherein the angle of the lateral faces corresponds approximately to the angle $\beta$.

15. A profiled seal according to claim 11, wherein the ratio of the bridge widths to the diameter of the channels ranges from 1:2 to 1:4.

* * * * *